US005213529A

United States Patent [19]

Thomas

[11] Patent Number: 5,213,529

[45] Date of Patent: May 25, 1993

[54] OAR HORN

[75] Inventor: Charles A. Thomas, Stanwood, Wash.

[73] Assignee: Thomas Machine and Foundry, Inc., Lynnwood, Wash.

[21] Appl. No.: 759,318

[22] Filed: Sep. 13, 1991

[51] Int. Cl.[5] ..... B63H 16/06

[52] U.S. Cl. ..... 440/106; 440/107

[58] Field of Search ..... 440/104, 105, 106, 107, 440/108, 109; 416/74

[56] References Cited

U.S. PATENT DOCUMENTS

| | | | |
|---|---|---|---|
| 1,650,418 | 11/1927 | Bjork | 440/107 |
| 1,757,378 | 5/1930 | Mathewson | 440/109 |
| 1,864,098 | 6/1932 | Sisson | 440/107 |
| 2,154,018 | 4/1939 | Wagele | 440/107 |
| 2,550,625 | 4/1951 | Vick | 440/107 |
| 3,191,203 | 6/1965 | McClay | 440/107 |

*Primary Examiner*—Joseph F. Peters, Jr.
*Assistant Examiner*—Stephen P. Avila
*Attorney, Agent, or Firm*—Seed and Berry

[57] ABSTRACT

An improved oar horn assembly includes a socket constructed to be fixed to the side of a boat for rotatably mounting an oar horn. The oar horn includes a ring having a substantially ovular through-hole for receiving the oar. The ovular through-hole is constructed so that it contacts the oar at two points on substantially opposite sides of the oar to thereby support the oar within the oar horn. Since the oar is supported by contact on two opposite sides thereof, ratcheting is reduced. Further, due to the oval nature of the new oar horn design, an increased angle of attach to water may be obtained.

5 Claims, 1 Drawing Sheet

FIG. 1
PRIOR ART
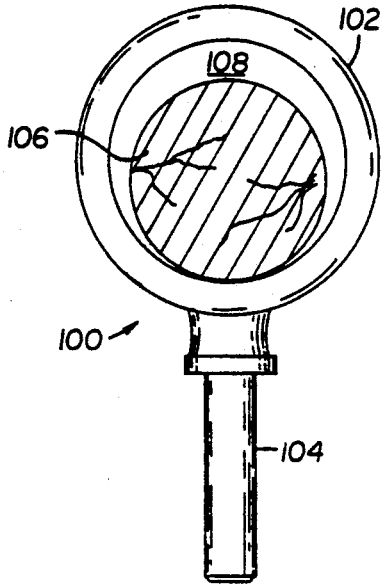
FIG. 2
PRIOR ART
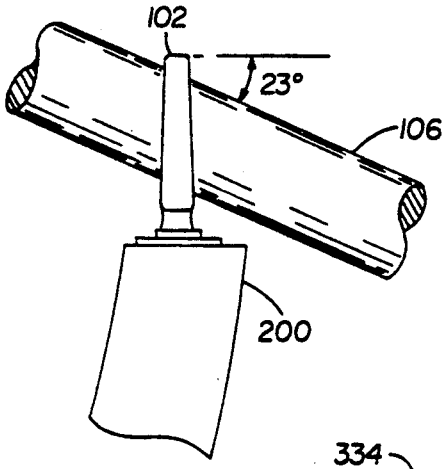
FIG. 4
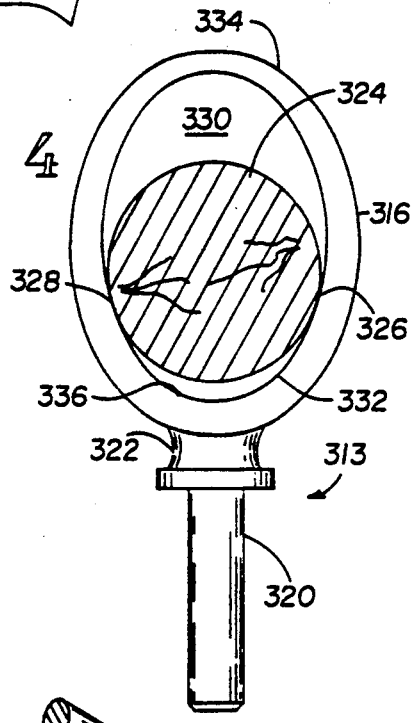
FIG. 3
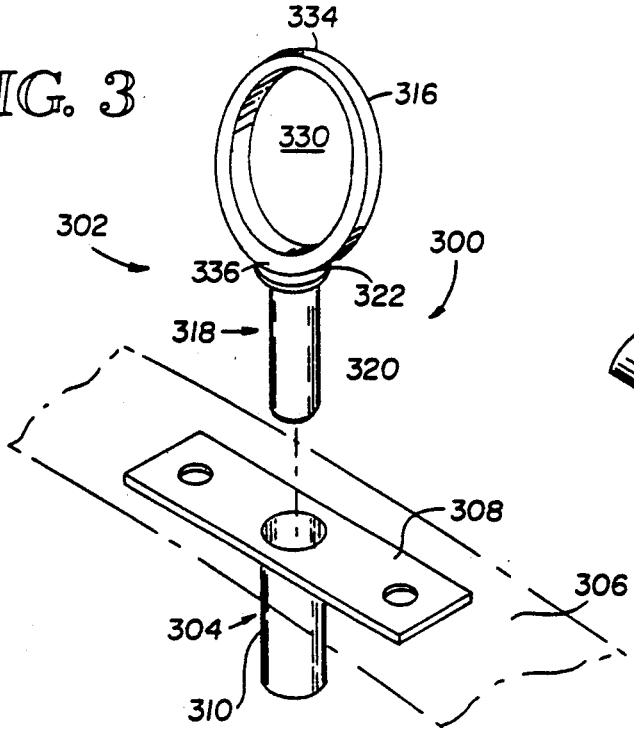
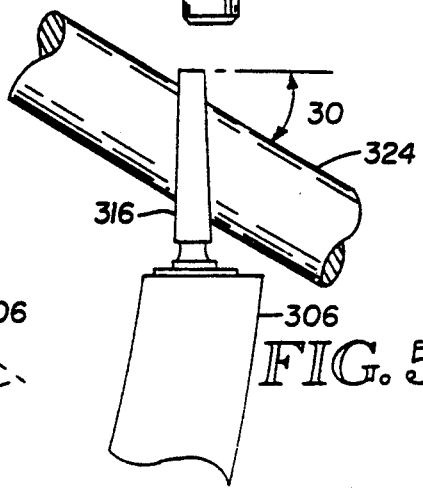
FIG. 5

OAR HORN

TECHNICAL FIELD

The present invention is directed toward oar horns for use with an oar of a rowboat and, more particularly, toward an improved oar horn assembly.

BACKGROUND OF THE INVENTION

Oar horns are provided for receiving and supporting an oar on the side of a boat. A prior art oar horn 100 is illustrated in FIGS. 1 and 2. The oar horn 100 includes an oar receiving ring 102 fixed to a shank 104. The shank 104 is constructed for mating with a socket fixedly mounted to a side 200 (FIG. 2) of a rowboat. The ring 102 generally includes a substantially circular through-hole 108 through which an oar 106 is threaded. In operation, the ring 102 and shank 104 are rotatably mounted in the socket so that the oar can be moved back and forth through a rowing cycle, as is known in the art.

Prior art oar horns that have a substantially circular through-hole, such as that shown in FIGS. 1 and 2, result in the oar 106 resting at the bottom of the through-hole 108. Accordingly, the oar is loosely supported at only one point in the through-hole. This results in the oar ratcheting out of the oar horn and working its way toward the center of the boat as the oars are moved back and forth through the rowing cycle. Accordingly, it is desirable to provide an oar horn that provides improved support to the oar to prevent ratcheting of the oar as they are moved through the rowing cycle.

Other prior art oar horns, similar in construction to the oar horn 100, have been provided with a pivoting pin that is threaded through the oar 106 and is fixed to the ring 102 so that the oar is pivotally fixed to the ring of the oar horn. While these oar horns provide a good hold on the oar to prevent ratcheting, they are undesirable since each oar must be provided with its own oar horn and since the oar horn cannot be removed from the oar. Accordingly, it is desirable to provide an oar horn that securely receives an oar to prevent ratcheting and that does not require a fixed relationship between the oar and oar horn.

With further reference to FIGS. 1 and 2, the prior art oar horn 100 illustrated only permits the oar 106 to be adjusted to a maximum angle of approximately 23 degrees with respect to the horizon. This angle, referred to as the angle of attack to water, is preferably maximized so that the oar horn can be used with boats having a high free-board or with shorter oars. Accordingly, it is desirable to provide an oar horn that permits a maximum angle of attack to water.

SUMMARY OF THE INVENTION

The prevent invention comprises an oar assembly for supporting an oar on a boat. The oar assembly includes an oar horn for receiving the oar. The oar horn has an oar-receiving through-hole shaped so that when the oar is inserted in the through-hole, the oar contacts the oar horn at two points on substantially opposite sides of the oar and is thereby supported in the oar horn. In the presently preferred embodiment of the invention, the oar receiving through-hole is comprised of a substantially oval shape and, more preferably comprises an ellipse.

BRIEF DESCRIPTION OF THE DRAWINGS

FIG. 1 is a partial sectional view of a prior art oar horn;

FIG. 2 is a side elevation view of a prior art oar horn coupled to a boat;

FIG. 3 is an exploded perspective view of the improved oar horn that is the subject of the present invention;

FIG. 4 is a side view of the improved oar horn that is the subject of the present invention; and FIG. 5 is a side elevation view, partly in section, of the improved oar horn that is the subject of the present invention.

DETAILED DESCRIPTION OF THE INVENTION

With reference to FIG. 3, an improved oar horn assembly 300 includes an oar horn 302 and a socket 304. The socket 304 is provided to be mounted to a side 306 of a boat, as is known in the art. The oar horn 302 is provided for receiving an oar to be used for rowing the boat. The oar horn 302 is constructed to be pivotally coupled to the socket 304, as will be discussed in more detail below, for permitting the oar to be easily moved in a back and forth motion to define a rowing cycle.

The socket 304 includes a mounting portion 308 fixed to a sleeve 310. The sleeve 310 is constructed to fit within a channel of the boat. The mounting portion 308 comprises a substantially planar, rectangular shaped member constructed to support the sleeve 310 by resting on the top of the side 306 of the boat. The mounting portion 308 includes first and second mounting through-holes 314 and 316, respectively, for securing the socket 304 to the side of the boat 306.

As is known in the art, the socket is constructed and designed to be substantially fixed to the boat. In this regard, the sleeve 310 is mated with the channel so that the mounting portion 308 supports the sleeve 310 on the side of the boat. The mounting portion 308 is then fixed to the boat by using securing members, such as screws, through the through-holes 314 and 316 so that the socket 304 is fixed to the side 306 of the boat. It will be apparent to those skilled in the art, however, that the socket 304 may be fixed to the side of the boat in various other manners for supporting the sleeve 310 in the channel.

The oar horn 302 includes an oar receiving ring 316 and a base portion 318. The base portion 318 includes a substantially cylindrical shank 320 sized to rotatably mate with the sleeve 310 of the socket 304. The base 318 further includes a support member 322 fixed intermediate the shank 320 and the ring 316 for supporting the ring upon the mounting portion 308 of the socket so that the oar horn 302 is rotatably supported in the socket 304. Those skilled in the art will appreciate that although the invention is described herein by reference to a cylindrical shank constructed for mating with a sleeve to permit rotational motion of the oar horn 302 with respect to the side 306 of the boat, other configurations could be substituted therefore without departing from the true scope and spirit of the invention.

Advantageously, the ring 316 is shaped so that when an oar 324 is inserted in the ring, the oar contacts the ring at two points 326 and 328, FIG. 4, on substantially opposite sides of the oar 324. The shape of the ring 316 is selected so that the contact between the ring 316 and the oar 324 at the points 36 and 328 supports the oar in the ring 316. Accordingly, the ring 316 provides a tight hold on the oar 324, relative to the prior art oar horn 100 illustrated in FIG. 1, and substantially prevents the oar 324 from ratcheting in toward the center of the boat during the rowing cycle.

Further, the ring 316 is constructed with a through-hole 330 having a shape selected so that its vertical dimension is greater than that typically provided in prior art oar horns, such as prior art oar horn 100 illustrated in FIG. 1. The increased vertical dimension of the through-hole 330 permits the oar to be moved at a greater angle of attack to the water than with prior art oar horns, thereby making the improved oar horn 330 more useful with boats having a high free-board and with short oars.

In the presently preferred embodiment of the invention, the through-hole 330 is substantially ovular in shape, thereby defining a contact portion 332 of the ring 316 wherein the curvature of the contact portion is greater than the curvature of the oar 324. Most preferably, the shape of the through-hole 330 is that of an ellipse wherein the degree of the ellipse ranges from 20 to 35 degrees. As illustrated in FIGS. 3 and 4, the ring 316 comprises a substantially elongated member having a top end 334 and bottom end 336. The bottom end 336 is fixed to the support member so that when the shank 320 is mated with the sleeve 310, the top end extends outward from the boat. The top 334 and the bottom 336 define an ellipse wherein the vertical height of the ellipse is greater than its horizontal width.

Those skilled in the art will appreciate, however, that the through-hole 330 may be comprised of shaped other than ovular or elliptical without departing from the true scope of the invention. As an example, the through-hole 330 may have be formed of a plurality of flat surfaces, such as a polygon. Further, it will be apparent to those skilled in the art that more than two contact points may be provided without departing from the invention. Using the previous example, a through-hole having a polygonal shape may provide four or more contact points. Accordingly, many shapes for the through-hole 330 of the ring 316 may be provided so long as at least two contact points are provided. Still further, it is desirable to provide at least two contact points on substantially opposite sides of the oar, however, those skilled in the art will appreciate that it is not necessary that the two contact points be opposing to incorporate the features of the invention.

Using the improved oar horn 302 of the subject invention, a greater angle of attack to water may be obtained due to the increased height of the ring 316. As shown in FIG. 4, an angle of attack to water of approximately 30 degrees may be obtained using the improved oar horn that is the subject of the present invention. Further, since the oar 324 contacts the ring 316 at two points 326 and 328, a gap exists between the oar 324 and the bottom 336 of the ring 316. Accordingly, the oar is securely held to the ring 316 by its contact with the contact points 326 and 328. This improved structure for an oar horn greatly reduces ratcheting that results from use of prior art oar horn.

It will be apparent to those skilled in the art that although only several presently preferred embodiments of the invention have been described in detail herein, many modifications and variations may be provided without departing from the true scope and spirit of the invention. Accordingly, the invention is not limited except as by the appended claims.

I claim:

1. An oar assembly for supporting an oar on a side of a rowboat wherein the side of the rowboat includes a channel for receiving the oar assembly, said oar assembly comprising:

a socket having a mounting portion and a sleeve portion, said mounting portion being substantially rectangular and having first and second ends, said mounting portion further including first and second mounting through-holes positioned proximate said first and second ends, respectively, and a central through-hole positioned intermediate said first and second mounting through-holes, said sleeve portion including a substantially tubular member having a through channel and being fixed to said mounting portion proximate said central through-hole such that said central through-hole is aligned with said through channel, said sleeve portion being constructed to be mounted in the channel of the side of the rowboat and supported by said mounting portion, said mounting portion being constructed to be fixed to said side of the rowboat by said mounting through-holes to fixedly position said sleeve in the channel of the side of the rowboat; and an oar horn having an oar receiving portion and a base portion, said base portion including a substantially cylindrical shank sized to rotatably mate with said sleeve of said socket, said base further including a support member fixed intermediate said shank and said oar receiving portion for supporting said oar receiving portion upon said mounting portion of said socket such that said oar horn is rotatably supported in said socket, said oar receiving portion comprising an elongate member having a top end and a bottom end wherein said bottom end of said elongate member is fixed to said support member so that when said shank is mated with said sleeve said top end extends outward from the boat, said elongate member including a substantially oval shaped through-hole having a contact portion proximate said bottom of said elongate member, wherein the curvature of said contact portion is greater than the curvature of the oar so that the oar contacts said contact portion of said oval shaped through-hole at two points on substantially opposite sides of said oar and is thereby moveably and pivotally supported in said oval shaped through-hole so that said oar is movable with respect to said oar horn and so that said oar can be pivoted with respect to said oar horn.

2. An oar assembly for supporting an oar on a side of a rowboat, said oar assembly comprising:

an oar horn for receiving the oar, said oar horn including a ring having a top end and a bottom end, said ring including a substantially oval shaped through-hole having a contact portion proximate said bottom end of said ring, wherein the curvature of said contact portion is greater than the curvature of the oar so that when the oar is inserted in said oval shaped through-hole the oar contacts said contact portion on at least two points on substantially opposite sides of the oar and is thereby moveably and pivotally supported in said oval shaped through-hole so that said oar is movable and pivotable with respect to said oar horn; and support means for rotatably mounting said oar horn to the side of the rowboat.

3. The oar assembly as recited in claim 2 wherein the side of the rowboat further includes a channel, said oar assembly further comprising:

socket means for rotatably supporting said oar horn in the channel, said socket means including a mounting portion for fixedly mounting said socket means to the side of the rowboat and a sleeve portion for mating with the channel of the rowboat; and shank means fixed to said bottom end of said elongate member for mating with the sleeve portion of said socket means, said shank means being constructed to be removably mounted to said socket means for rotatably supporting said oar horn upon the side of the rowboat.

4. The oar assembly as recited in claim 2 wherein said substantially oval shaped through-hole comprises an ellipse.

5. The oar assembly as recited in claim 4 wherein the degree range for said ellipse is between 20 and 35 degrees.

* * * * *